US006939415B2

(12) United States Patent
Iseda et al.

(10) Patent No.: US 6,939,415 B2
(45) Date of Patent: Sep. 6, 2005

(54) AUSTENITIC STAINLESS STEEL AND MANUFACTURING METHOD THEREOF

(75) Inventors: Atsuro Iseda, Kobe (JP); Hiroyuki Semba, Sanda (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 8 days.

(21) Appl. No.: 10/760,401

(22) Filed: Jan. 21, 2004

(65) Prior Publication Data

US 2004/0206427 A1 Oct. 21, 2004

(30) Foreign Application Priority Data

Jan. 29, 2003 (JP) ..... 2003-020851
Dec. 5, 2003 (JP) ..... 2003-407074

(51) Int. Cl.[7] ..... C22C 38/18

(52) U.S. Cl. ..... 148/325; 148/326; 148/327; 420/43; 420/45; 420/46; 420/47; 420/48

(58) Field of Search ..... 148/325–327; 420/43, 45–48

(56) References Cited

U.S. PATENT DOCUMENTS 4,437,900 A * 3/1984 Petkovic-Luton ..... 148/593
4,560,408 A * 12/1985 Wilhelmsson ..... 420/46

FOREIGN PATENT DOCUMENTS

| | | |
|---|---|---|
| EP | 0708184 | 4/1996 |
| GB | 2138446 | 10/1984 |
| JP | 57-164971 | 10/1982 |
| JP | 59-023855 | 2/1984 |
| JP | 63183155 | 7/1988 |
| JP | 11-061345 | 3/1999 |
| JP | 11-061345 | * 5/1999 |
| JP | 11-293412 | 10/1999 |
| JP | 2001-011583 | 1/2001 |
| JP | 2001107196 | * 4/2001 |
| JP | 2002069591 | * 3/2002 |

* cited by examiner

*Primary Examiner*—Sikyin Ip
(74) *Attorney, Agent, or Firm*—Clark & Brody

(57) ABSTRACT

An austenitic stainless steel excellect in high temperature strength and creep rupture ducitility which comprises, on the percent by mass basis, C: 0.03–0.12%, Si: 0.2–2%, Mn: 0.1–3%, P: 0.03% or less, S: 0.01% or less, Ni: more than 18% and less than 25%, Cr: more than 22% and less than 30%, Co: 0.04–0.8%, Ti: 0.002% or more and less than 0.01%, Nb: 0.1–1%, V: 0.01–1%, B: more than 0.0005% and 0.2% or less, sol. Al: 0.0005% or more and less than 0.03%, N: 0.1–0.35% and O (Oxygen): 0.001–0.008%, with the balance being Fe and impurities. The austenitic stainless steel may contain a specified amount of one or more element(s) of Mo and W, and/or a specified amount of one or more element(s) of Mg, Zr, Ca, REM, Pd and Hf.

12 Claims, No Drawings

AUSTENITIC STAINLESS STEEL AND MANUFACTURING METHOD THEREOF

This application claims priority under 35 U.S.C. § § 119 and/or 365 to Japanese Patent Application Nos. 2003-20851 and 2003-407074 filed in Japan on Jan. 29, 2003 and Dec. 5, 2003, respectively, the entire content of which is herein incorporated by reference.

FIELD OF THE INVENTION

The present invention relates to an austenitic stainless steel suitable for materials such as a steel tube, which is used in a superheater tube and a reheater tube for a boiler, and a furnace tube for the chemical industry, and a steel plate, a steel bar and a steel forging, which are used as a heat resistant pressurized member, and the like, an austenitic stainless steel excellent in high temperature strength and creep rupture ductility, and a manufacturing method thereof.

BACKGROUND OF THE INVENTION

Highly efficient Ultra Super Critical Boilers, with advanced steam temperature and pressure, have recently been built in the world. Specifically, it has been planned to increase steam temperature, which was about 600° C., to 650° C. or more or further to 700° C. or more. Energy saving, efficient use of resources and the reduction in the $CO_2$ emission for environmental protection are the objectives for solving energy problems, which are based on important industrial policies. And further, a highly efficient Ultra Super Critical Boiler and a furnace are advantageous for an electric power-generation and a furnace for the chemical industry, which burn fossil fuel.

High temperature and high pressure steam increases the temperature of a superheater tube for a boiler and a furnace tube for the chemical industry, and also a steel plate, a steel bar and a steel forging, which are used as heat resistant pressurized members, and the like, during the practical operation, to 700° C. or more. Therefore, not only the high temperature strength and the hot corrosion and steam oxidation resistance, but also the excellent stability of a microstructure for a long period of time, the excellent creep rupture ductility and the excellent creep fatigue strength are required for the steel used in such a severe environment.

An austenitic stainless steel is much better in the high temperature strength and the hot corrosion and steam oxidation resistance more than a ferritic steel. Accordingly, austenitic stainless steels can be used in high temperatures of 650° C. or more, where a ferritic steel cannot be used due to its strength and corrosion resistance. Typical austenitic stainless steels include 18 Cr-8 Ni type steels (hereinafter referred to as 18-8 type steels) such as TP 347H and TP 316H, and 25 Cr type steels such as TP 310 and the like. However, even the austenitic stainless steel has application limits in the high temperature strength and the hot corrosion and steam oxidation resistance. Further, although conventional 25 Cr type TP 310 steels have better hot corrosion and steam oxidation resistance than 18-8 type steels, they have lower high-temperature strength at temperatures of 650° C. or more.

Thus, various methods to improve both the high temperature strength and the hot corrosion and steam oxidation resistance have been tried. The following austenitic stainless steels have been proposed.

(1) Japanese Laid-Open Patent Publication No. 57-164971 discloses a steel in which the creep strength at a high temperature was improved by a combined addition of Al and Mg in addition to a large amount of N (Nitrogen).

(2) Japanese Laid-Open Patent Publication No. 11-61345 discloses a steel in which the high temperature strength and hot workability were improved by a combined addition of Al and N in addition to a suitable amount of B (boron), and by limiting the O (Oxygen) content to 0.004% or less.

(3) Japanese Laid-Open Patent Publication No. 11-293412 discloses a steel in which the hot workability was improved by a combined addition of Al, N, Mg and Ca, and by limiting the O (Oxygen) content to 0.007% or less.

(4) Japanese Laid-Open Patent Publication No. 2001-11583 discloses a steel in which precipitation strengthening or solid-solution strengthening was tried due to the nitride by addition of N, and the toughness of the steel used for a long period of time was improved by limiting the respective contents of Cr, Mn, Mo, W, V, Si, Ti, Nb, Ta, Ni and Co to specified levels or less, while associated therewith thereby to suppressing the precipitation of sigma phases without decreasing high temperature strength.

(5) Japanese Laid-Open Patent Publication No. 59-23855 discloses a steel in which the high temperature strength was improved by adding one or more of Ti, Nb, Zr and Ta in 1–13 times C content of in their total in a range of 1–10 times of C content, and making the microstructure of the steel a structure of No. 3-5 in the JIS austenitic grain size number.

SUMMARY OF THE INVENTION

The above-mentioned steels (1) to (5) have the following problems. That is, since in creep at high temperatures of 700° C. or more, grain sliding creep, which is different from dislocation creep in a grain, is predominant, only the strengthening in grains is insufficient, and therefore, the strengthening of grain boundaries are needed.

However, in precipitation strengthened steels due to N added carbo-nitride or intermetallic compounds, which were disclosed in the above mentioned (1) to (4) and the above (5), which also discloses a N added steel, creep strength in grains is improved but grain sliding creep is generated and creep rupture ductility is remarkably lowered so that the creep fatigue strength is decreased.

Further, in a precipitation strengthened steel, due to carbo-nitride of Ti and/or Nb, the growth of grains is suppressed during the manufacturing of the steel so that the nonuniform mixed grain structure is liable to be obtained. Accordingly, there are disadvantages that the grain sliding creep is liable to occur at temperatures of 700° C. or more and the nonuniform creep deformation occurs, whereby the strength and ductility are significantly lost.

These properties of low creep fatigue life and creep rupture ductility generate a problem such as an unexpected short time breakage at a metal fitting weld, which is restrained, thereby losing reliability of the material at high temperature.

Further, since the above-mentioned steels (1) to (5) are not materials in which creep rupture ductility at high temperatures of 700° C. or more, the nonuniform creep deformation and creep fatigue strength were sufficiently considered, and there is a problem that even if the high temperature strength of its base metal is improved, the steel has no reliability as a structural material.

As described in detail later, to suppress the grain sliding creep at temperatures of 700° C. or more, and the nonuniform creep deformation, the addition of a large amount of Ti is harmful and the combined addition of a very small amount of Ti and a suitable amount of O (Oxygen), and optimization of microstructure are indispensable. However, in the invention of the above-mentioned steels (1) to (5), these points are not considered at all.

Thus, the present invention was made in consideration of the above-mentioned circumstances.

The first objective of the present invention is to provide an austenitic stainless steel used as a material from which the steel of the second objective can be reliably obtained.

The second objective of the present invention is to provide an austenitic stainless steel excellent in high temperature strength and creep rupture ductility in which creep rupture time exceeds 10000 hours under the conditions of a temperature of 700° C. and a load stress of 100 MPa and a creep rupture reduction of area is 15% or more.

The third objective of the present invention is to provide a manufacturing method of an austenitic stainless steel excellent in high temperature strength and creep rupture ductility, from which the steel of the second objective can be reliably, stably manufactured.

The gist of the present invention is austenitic stainless steels described in the following (1) to (4) an austenitic stainless steel excellent in high temperature strength and creep rupture ductility, described in the following (5), and a manufacturing method of austenitic stainless steels excellent in high temperature strength and creep rupture ductility, described in the following (6).

(1) An austenitic stainless steel which comprises, on the percent by mass basis, C: 0.03–0.12%, Si: 0.2–2%, Mn: 0.1–3%, P: 0.03% or less, S: 0.01% or less, Ni: more than 18% and less than 25%, Cr: more than 22% and less than 30%, Co: 0.04–0.8%, Ti: 0.002% or more and less than 0.01%, Nb: 0.1–1%, V: 0.01–1%, B: more than 0.0005% and 0.2% or less, sol. Al: 0.0005% or more and less than 0.03%, N: 0.1–0.35% and O (Oxygen): 0.001–0.008%, with the balance being Fe and impurities.

(2) An austenitic stainless steel which comprises, in addition to the compositions described in the above-mentioned (1), on the percent by mass basis, one or more element(s) selected from a group of Mo and W of 0.1–5% in single or total content, with the balance being Fe and impurities.

(3) An austenitic stainless steel which comprises, in addition to the compositions described in the above-mentioned (1), on the percent by mass basis, one or more element(s) of a group of Mg of 0.0005–0.01%, Zr of 0.0005–0.2%, Ca of 0.0005–0.05%, REM of 0.0005–0.2%, Pd of 0.0005–0.2%, and Hf of 0.0005–0.2%, with the balance being Fe and impurities.

(4) An austenitic stainless steel which comprises, in addition to the compositions described in the above-mentioned (1), on the percent by mass basis, one or more element(s) selected from a group of Mo and W of 0.1–5% in single or total content, and further containing one or more of Mg of 0.0005–0.01%, Zr of 0.0005–0.2%, Ca of 0.0005–0.05%, REM of 0.0005–0.2%, Pd of 0.0005–0.2%, and Hf of 0.0005–0.2%, with the balance being Fe and impurities.

(5) An austenitic stainless steel excellent in high temperature strength and creep rupture ductility according to any one of the above-mentioned (1) to (4), wherein the microstructure of said steel is a uniform grain structure having the ASTM austenitic grain size number of 0 or more and less than 7 and the mixed grain ratio of 10% or less.

(6) A method of manufacturing an austenitic stainless steel excellent in high temperature strength and creep rupture ductility comprising the steps of, before the hot or cold final working of a steel having chemical compositions according to any one of the above-mentioned (1) to (4), heating said steel to 1200° C. or more at least once, and subjecting the steel to a final heat treatment at 1200° C. or more and at a temperature, which is 10° C. or more higher than the final working end temperature when the final working is hot working, or subjecting the steel to a final heat treatment at 1200° C. or more and at a temperature, which is 10° C. or more higher than the final heating temperature in said at least once heating when the final working is cold working.

REM means rare earth metals in the present invention and represents 17 elements of Sc, Y and lanthanoid.

The austenitic grain size number is the grain size number defined in ASTM (American Society for Testing and Material), and it is referred to as only "ASTM grain size number" hereinafter.

The mixed grain ratio (%) is a value defined by the following expression (1) when among the number N of fields observed in the judgment of the above-mentioned ASTM austenitic grain size number, the number of fields judged as mixed grains is n.

$$(n/N)\times 100 \quad (1)$$

Here the mixed grains are judged when grains exist whose grain size number is different, by about 3 or more, from that of grains having the maximum frequency within one field, and in which these grains occupy about 20% or more of the area.

DETAILED DESCRIPTION OF THE INVENTION

The present invention has been completed based on the following knowledge.

(a) The dispersion strengthening and/or the precipitation strengthening due to carbo-nitride and/or intermetallic compounds containing a large amount of Ti, which was a conventional technical common sense, promote nonuniform grain sliding creep deformation at a high temperature of 700° C. or more thereby leading to a reduction in strength, ductility and creep fatigue life.

(b) When the microstructure of steel is coarsened and the grains are made uniform so that they have a small amount of mixed grains, the above-mentioned nonuniform grain sliding creep deformation is suppressed. That is, when the microstructure is made of a structure of less than 7, according to the austenitic grain size number defined by ASTM, the nonuniform grain sliding creep deformation is suppressed. Particularly, when the microstructure of steel is made of a uniform grain structure, which has the ASTM austenitic grain size number of less than 7 and whose mixed grain ratio, defined by the above-mentioned expression (1), is 10% or less, the nonuniform grain sliding creep deformation is further suppressed.

(c) A uniform grain structure, having the ASTM austenitic grain size number of less than 7 and a mixed ratio of 10% or less, can be obtained by a combined addition of a very small amount of Ti and a suitable amount of O (Oxygen). Particularly, when Ti of from 0.002% to less than 0.01% and O (Oxygen) of from 0.001% to 0.008% are added together, the above-mentioned structure can be stably obtained.

Specifically, the uniform grain structure can be obtained, for example, by controlling the amount of O (Oxygen) mixed during steel making, adding a very small amount of Ti and the dispersion precipitating fine oxides of Ti. This is because the undissolved carbo-nitrides of Ti are not generated. This mechanism takes place because the carbo-nitride of Nb is finely dispersion precipitated in steel by using the stable fine oxide of Ti as a nucleus during middle heat treatment before the final working, thereby generating uniform recrystallization during the final heat treatment, or to prevent the growth of nonuniform grains, which may lead to mixed grains.

Further, when no undissolved carbo-nitride of Ti is generated in steel, the carbo-nitride of Nb, which is nucleated from the fine oxide of Ti dispersed during steel manufacturing, does precipitate finely and uniformly in grains and grain boundaries, during creep deformation in its use. As a result the nonuniform creep deformation, which is generated at 700° C. or more, is suppressed, and at the same time, reduction in the creep rupture ductility and creep fatigue life can be significantly improved. As a result it has been found that the creep strength at high temperature is also improved.

The reasons why austenitic stainless steels of the present invention, austenitic stainless steels excellent in high temperature strength and creep rupture ductility comprising the former steel as well as manufacturing methods thereof, have been defined as mentioned above, will be described below. The "%" means "% by mass" in the following descriptions as long as the "%" is not further explained.

1. Chemical Compositions

C: 0.03–0.12%

C (Carbon) is an important element, which forms carbide. A content of carbon necessary for ensuring tensile strength and creep rupture strength at high temperature, which are suitable for high temperature austenitic stainless steel, is at least 0.03%. However, excessive carbon generates a large amount of undissolved carbide during working which increase the total amount of carbide in the product so that weldability is decreased. Particularly, if the content of carbon exceeds 0.12%, the reduction of the weldability is significant. Therefore, the content of C is set to 0.03–0.12%. It is noted that the lower limit content of C is preferably 0.04%, and more preferably 0.05%. Further, the upper limit content of C is preferably 0.08%, and more preferably 0.07%.

Si: 0.2–2%

Si (Silicon) is added as a deoxidizing element. Further, Si is an important element to improve the steam oxidation resistance of steel. Si content of 0.2% or more is needed to obtain these effects. However, if the Si content exceeds 2%, not only workability is decreased, but also the stability of the structure at high temperature becomes worse. Accordingly, the content of Si is set to 0.2–2%. It is noted that the lower limit content of Si is preferably 0.25%, and more preferably 0.3%. Further, the upper limit content of Si is preferably 0.6%, and more preferably 0.5%.

Mn: 0.1–3%

Mn (Manganese) combines with S in steel to form MnS, and improves hot workability. However, if the Mn content is less than 0.1%, this effect cannot be obtained. On the other hand, if there is excessive Mn content, the steel becomes hard and brittle, and the workability and/or weldability of the steel decrease. Particularly, if the Mn content exceeds 3%, the workability and/or weldability of the steel decrease significantly. Accordingly, the content of Mn is set to 0.1–3%. It is noted that the lower limit content of Mn is preferably 0.2%, and more preferably 0.5%. Further, the upper limit content of Mn is preferably 1.5%, and more preferably 1.3%.

P: 0.03% or Less

P (Phosphorus) is unavoidably mixed into steel as an impurity. Since excessive P remarkably decreases weldability and workability of the steel, the upper limit content of P is set to 0.03%. A preferable P content is 0.02% or less and the smaller amount of P content is better.

S: 0.01% or Less

S (Sulfur) is unavoidably mixed into steel as an impurity. Since excessive S decreases weldability and workability of the steel, the upper limit content of S is set to 0.01%. A preferable S content is 0.005% or less and the smaller amount of S content is also better.

Ni: More than 18% and Less than 25%

Ni (Nickel) is an alloying element, which stabilizes the austenite, and is important to ensure corrosion resistance. Ni content of more than 18% is needed from a balance with the Cr content, which is described next. On the other hand, Ni content of 25% or more not only leads to an increase in cost, but also leads to reduction in creep strength. Accordingly, the Ni content is set to more than 18% and less than 25%. It is noted that the lower limit of the Ni content is preferably 18.5%. Further, the upper limit of the Ni content is preferably 23%.

Cr: More than 22% and Less than 30%

Cr (Chromium) is an important alloying element to ensure the oxidation resistance, the steam oxidation resistance and the corrosion resistance. Further, Cr forms Cr type carbo-nitride to increase strength. Particularly, to improve the hot corrosion and steam oxidation resistance at 700° C. or more to a level higher than a 18-8 type steel, Cr content of more than 22% is needed. On the other hand, excessive Cr decreases the stability of the structure of steel, thereby facilitates the generation of intermetallic compounds such as the sigma phase and the like and decreases the creep strength of the steel. Further, an increased Cr content leads to an increased Ni content, which is expensive, for stabilizing the austenitic structure of the steel, resulting in an increase in cost. Particularly, if the Cr content is 30% or more, reduction in creep strength and an increase in cost become remarkable. Therefore, the content of Cr is set to more than 22% and less than 30%. It is noted that the lower limit content of Cr is preferably 23%, and more preferably 24%. Further, the upper limit content of Cr is preferably 28%, and more preferably 26%.

Co: 0.04–0.8%

Co (Cobalt) assists Ni to stabilize the austenite of steel. Further, Co improves creep rupture strength at 700° C. or more. However, if a content of Co is less than 0.04%, the effects cannot be obtained. On the other hand, since Co is a radio-active element, the upper limit content of Co is set to 0.8% so as not to pollute a melting furnace or the like. It is noted that the lower limit content of Co is preferably 0.05%, and more preferably 0.1%. Further, the upper limit content of Co is preferably 0.5%, and more preferably 0.45%.

Ti: 0.002% or More and Less than 0.01%

Ti (Titanium) is the most important alloying element in the present invention. Since Ti forms undissolved carbo-nitrides having the precipitation strengthening action, it has been positively added to steel. However, the undissolved carbo-nitride of Ti becomes causes of making grains mixed ones, nonuniform creep deformation and/or reduction in ductility.

On the other hand, since an oxide of fine Ti becomes a precipitated nucleus of above-mentioned carbo-nitride of Nb in softening heat treatment before the final working, the carbo-nitride of Nb can be dispersion precipitated finely. Then the finely dispersion precipitated carbo-nitride of Nb generates uniform recrystallization during the final heat treatment and prevents the growth of nonuniform grains, which lead to mixed grains.

Further, when no undissolved carbo-nitride of Ti is generated in steel, the carbo-nitride of Nb, which is nucleated from the fine oxide of Ti dispersed during steel manufacturing, does precipitate finely and uniformly in grains and grain boundaries, during creep deformation in its use. As a result the nonuniform creep deformation, which is generated at 700° C. or more, is suppressed, and reduction in the creep rupture ductility and the creep fatigue life are significantly improved. As a result, the creep strength at high temperature is also improved.

As explained above, to form a stable fine oxide without generating carbo-nitride, a Ti content of at least 0.002% is needed. On the other hand, if the Ti content is 0.01% or more, unnecessary carbo-nitride is generated whereby the creep rupture ductility and the creep fatigue strength decreases. Accordingly, the content of Ti is set to 0.002% or more and less than 0.01% in the present invention. It is noted that the lower limit content of Ti is preferably 0.004%, and more preferably 0.005%. Further, the upper limit content of Ti is preferably 0.009%, and more preferably 0.008%.

Nb: 0.1–1%

Nb (Niobium) is finely dispersion precipitated as carbo-nitride to contribute to the improvement of creep strength. Thus, to obtain this effect the Nb content of at least 0.1% is needed. However, a large addition amount of Nb decreases weldability. Particularly, if the Nb content exceeds 1%, the reduction in weldability is significant. Accordingly, the content of Nb is set to 0.1–1%. It is noted that the lower limit content of Nb is preferably 0.3%, and more preferably 0.4%. Further, the upper limit content of Nb is preferably 0.6%, and more preferably 0.5%.

V: 0.01–1%

V (Vanadium) is precipitated as carbo-nitride and improves creep strength of the steel. However, if the V content is less than 0.01%, the effects cannot be obtained. On the other hand, if the V content exceeds 1%, a brittle phase is generated. Accordingly, the content of V is set to 0.01–1%. It is noted that the lower limit content of V is preferably 0.03%, and more preferably 0.04%. Further, the upper limit content of V is preferably 0.5%, and more preferably 0.2%.

B: More than 0.0005% and 0.2% or Less

B (Boron) exists in carbo-nitride in place of a part of C (Carbon) forming the carbo-nitride, or it exists in grain boundaries in a single body of B, whereby B has an effect to suppress grain sliding creep, which is generated at a high temperature of 700° C. or more. However, if the B content is 0.0005% or less, the effect cannot be obtained. On the other hand, if the B content exceeds 0.2%, weldability is lost. Accordingly, the content of B is set to more than 0.0005% and 0.2% or less. It is noted that the lower limit content of B is preferably 0.001%, and more preferably 0.0013%. Further, the upper limit content of B is preferably 0.005%, and more preferably 0.003%.

sol. Al: 0.0005% or More and Less than 0.03%

Al (Aluminum) is added as a deoxidizing element. To obtain a deoxidation effect, the content of Al as sol. Al should be 0.0005% or more. However, if a large amount of Al is added, the stability of the structure in the steel decreases, and therefore, the sigma phase embrittlement is generated. Particularly, if Al, which exceeds 0.03% as sol. Al, is contained in the steel, the sigma phase embrittlement becomes significant. Accordingly, the content of Al as sol. Al is set to 0.0005% or more and less than 0.03%. It is noted that the lower limit content of Al as sol. Al is preferably 0.005%. Further, the upper limit content of Al as sol. Al is preferably 0.02%, and more preferably 0.015%.

N: 0.1–0.35%

N (Nitrogen) is added to ensure precipitation strengthening due to carbo-nitride and the austenite stability at high temperature in place of a part of expensive Ni. To improve tensile strength and creep strength at high temperature, N content of 0.1% or more is needed. However, the addition of a large amount of N decreases the ductility, weldability and toughness of the steel, and particularly if the N content exceeds 0.35%, the reduction in ductility, weldability and toughness becomes significant. Accordingly, the content of N is set to 0.1–0.35%. It is noted that the lower limit content of N is preferably 0.15%, and more preferably 0.2%. Further, the upper limit content of N is preferably 0.3%, and more preferably 0.27%.

0:0.001–0.008%

O (Oxygen) is one of important elements in the present invention similar to Ti. To form the above-mentioned Ti oxide, the O (Oxygen) content of at least 0.001% is needed. On the other hand, if the O content exceeds 0.008%, oxide other than Ti oxide is formed. Then the oxide other than Ti oxide becomes an inclusion, which decreases creep rupture ductility and creep fatigue strength. Accordingly, the content of O is set to 0.001–0.008%. It is noted that the lower limit content of O is preferably 0.004%, and more preferably 0.005%. Further, the upper limit content of O is preferably 0.007%.

It is noted that Ti oxide can be produced by controlling the O content in the above-mentioned range during steel making and adding Ti into the steel so that the Ti content is in a range defined in the present invention, that is 0.02% or more and less than 0.01%.

One of an austenitic stainless steels and an austenitic stainless steels excellent in high temperature strength and creep rupture ductility according to the present invention, comprises the above-mentioned chemical composition as well as the substantial balance of Fe, in other words the Fe and impurities other than the above-mentioned elements.

The other of the said two austenitic stainless steels of the present invention contains at least one alloying element selected from at least one group of the following first group and second group. These elements will be explained below.

First Group (Mo and W)

Mo and W are effective alloying elements to improve the creep strength at high temperatures. Therefore, in a case where this effect is required, one or more of the Mo and W may be positively contained. In this case, the addition of 0.1% or more of the single or total content increases the effect. However, the addition of a large amount of Mo and W generates intermetallic compounds such as sigma phase and the like and impairs toughness, strength and ductility. Further, since Mo and W are strong ferrite-forming elements and lead to an increase in cost due to the need of an increased amount of Ni for the stabilization of austenite in steel, the upper limit of the single or total content may be set to 5%. The lower limit of the single or total content of Mo and W is preferably 0.5%, and more preferably 1%. The upper limit of the content is preferably 3%, and more preferably 2%.

Second Group (Mg, Zr, Ca, REM, Pd and Hf)

All of Mg, Zr, Ca, REM, Pd and Hf are effective elements to fix S so as to improve hot workability. Further, Mg has a deoxidation effect by the addition of a very small amount of Mg and has an effect to contribute to dispersed precipitation of said fine Ti oxide. When a large amount of Zr is added to the steel, it forms an oxide and/or nitride, which may lead to mixed grains. However, the addition of a very small amount of Zr has an effect to strengthen grain boundaries. REM has effects to produce harmless and stable oxide to improve corrosion resistance, creep ductility, thermal fatigue strength and creep strength.

Therefore, in a case where the effect is required, one or more of the above-mentioned elements may be positively added, and the effects can be obtained by each element at a content of 0.0005% or more. However, if the content of Mg exceeds 0.001%, the metallographic properties of the steel are impaired so that creep strength and/or creep fatigue strength and ductility are decreased. A Zr content of more than 0.2% forms oxide and/or nitride, which may not only lead to mixed grains, but also impairs the metallographic properties of the steel to decrease creep strength, and/or creep fatigue strength and also ductility. Further, a Ca content of more than 0.05% impairs ductility and workability. The respective contents of REM, Pd and Hf, which exceed 0.2%, form a large number of inclusions such as oxide and the like so that not only workability and weldability are impaired but also cost is increased.

Therefore, in element contents in a case of their addition, Mg content may be set to 0.0005–0.01%, the contents of Zr, REM, Pd and Hf may be set to 0.0005–0.2% and Ca content may be set to 0.0005–0.05%.

Preferable lower limits of the contents of those elements are as follows.

For Mg, Zr and Ca, their limits are 0.001%, and more preferably 0.002%. For REM, Pd and Hf, their limits are 0.01%, and more preferably 0.02%.

Preferable upper limits of contents of those elements are as follows.

For Mg, its limit is 0.008% and more preferably 0.006%, for Zr its limit is 0.1% and more preferably 0.05%, for Ca its limit is 0.03% and more preferably 0.01%, and for REM, Pd and Hf, their limits are 0.15% and more preferably 0.1%.

Here the REM that is rare earth elements in the present invention represents 17 elements of Sc, Y and lanthanoid, as mentioned above.

Impurities other than said P and S include Cu, which is often positively added to 18-8 type steels as a strengthening element. However, Cu has no effects to suppress grain sliding creep at 700° C. or more, and adversely affects on ductility. Accordingly, the Cu content as an impurity may be set to 0.5% or less, and preferably 0.2% or less.

2. Microstructure

The microstructure of an austenitic stainless steel excellent in high temperature strength and creep rupture ductility according to the present invention must be a uniform grain structure, which has the ASTM austenitic grain size number of 0 or more and less than 7, and has the mixed grain ratio of 10% or less. This reason is as follows.

A creep of steel at a temperature of less than 700° C. is a dislocation creep in which deformation in grains is main, and on the other hand, a creep of the steel at a temperature of 700° C. or more, is a grain sliding creep. This grain sliding creep significantly depends on the grain size of the steel. In a fine grain structure of the ASTM austenitic grain size number of 7 or more, a grain sliding creep is produced to lower strength significantly, thereby aimed creep rupture time cannot be ensured. On the other hand, in a coarse grain structure of the ASTM austenitic grain size number of less than 0, not only strength and ductility are impaired but also ultrasonic testing of products cannot be made. Further, if mixed grain ratio exceeds 10%, nonuniform creep deformation is generated thereby to lower the creep rupture ductility and creep fatigue strength. Thus the aimed creep rupture reduction of area cannot be ensured. These points are apparent from the results of examples, which will be described later. It is noted that a preferable upper limit of the ASTM austenitic grain size number is 6 and more preferably 5. On the other hand, a preferable lower limit of the ASTM austenitic grain size number is 3 and more preferably 4. Further, the lower limit of a preferable mixed grain ratio is 0%, in other words, a uniform grain structure having no mixed grains.

3. Manufacturing Method

An austenitic stainless steel excellent in high temperature strength and creep rupture ductility according to the present invention, which has the chemical composition and microstructure mentioned above, will be manufactured as follows. For example, as mentioned above, before the hot or cold final working of the steel having a chemical composition defined in the present invention, the steel is heated at least once to 1200° C. or more. Then, when the final working is hot working, the steel is subjected to a final heat treatment at 1200° C. or more, and at a temperature, which is 10° C. or more higher than the end temperature of the final working, on the other hand, when the final working is cold working, the steel is subjected to a final heat treatment at 1200° C. or more, and at a temperature, which is 10° C. or more higher than the final heating temperature in said at least once heating whereby the aimed steel can be reliably stably manufactured.

The reason the steel is heated to 1200° C. or more at least once before final hot or cold working is that the undissolved carbo-nitride of Ti, and Nb carbo-nitride and/or V carbo-nitride effective on the improvement of strength are allowed to dissolve at once. The reason for the heating temperature of 1200° C. or more is that a temperature of less than 1200° C. does not dissolve the said deposits sufficiently. Since a higher heating temperature is better, the upper limit of the heating temperature is not defined. However, if the heating temperature exceeds 1350° C., not only intergranular cracks at the high temperature or a reduction in ductility is liable to occur, but also the grains are extremely enlarged and workability is remarkably decreased. Accordingly, the upper limit of the heating temperature may be set to 1350° C.

Further, the hot working may use any hot working method. For example, in a case where the final products are steel tubes, the hot working may include hot extrusion represented by a Ugine-Sejournet method, and/or the rolling methods represented by the Mannesmann-Plug Mill rolling or the Mannesmann-Mandrel Mill rolling or the like. In a case where the final products are steel plates, the hot working may include a typical method of manufacturing the steel plates or the hot rolled steel plates sheet in coil. The end temperature of the hot working is not defined, but may be set to 1200° C. or more. This is because if the working end temperature is less than 1200° C., the dissolving of carbo-nitrides of said Nb, Ti and V is insufficient and the creep strength and/or the ductility are impaired.

The cold working may use any cold working method. For example, in a case where the final products are steel tubes, the cold working may include a cold drawing method in which a crude tube manufactured by the above-mentioned hot working is subjected to drawing and/or a cold rolling method by a cold Pilger Mill. In a case where the final products are steel plates, the cold working may include a typical method of manufacturing cold rolled steel sheet in coil.

It is noted that when the final working is cold working, the heating to 1200° C. or more at least once before this cold working may include any heating such as softening heating of a supplied crude material or softening heating subjected during repeated working.

The reason for this is when the final working is hot working, the steel is subjected to a final heat treatment at 1200° C. or more and at a temperature, which is 10° C. or more higher than the end temperature of the final working, on the other hand, when the final working is cold working, the steel is subjected to the final heat treatment at 1200° C. or more and at a temperature, which is 10° C. or more higher than the final heating temperature in said at least once heating before the final working, is as follows.

When the temperature of the final heat treatment is less than 1200° C. or when it is not a temperature, which is 10° C. or more higher than the working end temperature or the final heating temperature before the final working, a microstructure of the steel having the required ASTM austenitic grain size number of 0 or more and less than 7 and the mixed grain ratio of less than 10% cannot been obtained whereby the creep strength, the creep rupture ductility and the creep fatigue life at 700° C. or more are impaired. Although the upper limit of this final heat treatment temperature is not particularly defined, it may be preferably set to 1350° C. for the same reason as in the case where heating is performed at least once before the final working.

The cooling, after the heating performed at least once before the final working, and after the hot working and final heat treatment, is preferably performed at an average cooling rate of 0.25° C./sec or more at least from 800° C. to 500° C. This is due to the reduction in strength and corrosion resistance of the steel due to the generation of the coarse carbo-nitride during cooling is prevented.

Further, to make the microstructure of the steel uniform in order to obtain further stabilized strength, it is preferred that the working strain is given to the steel so as to obtain recrystallization and uniform grain during the heat treatment. Thus, when the final working is the cold working, the working is performed by a reduction of area of 10% or more, and when the final working is the hot working, the plastic working is performed by a reduction of area of 10% or more at a temperature of 500° C. or less before the final heat treatment, to impart strain to the steel.

The following Example illustrates the present invention more concretely. This Example is, however, by no means limitative of the scope of the present invention.

EXAMPLE

Thirty-six kinds of steels, having chemical compositions shown in Tables 1 and 2, were melted.

TABLE 1

| | | Chemical Composition (unit: mass %, balance: Fe and impurities) | | | | | | | | | |
|---|---|---|---|---|---|---|---|---|---|---|---|
| Steel | No. | C | Si | Mn | P | S | Ni | Cr | Co | Ti | Nb |
| Present Invention | 1 | 0.115 | 0.23 | 1.05 | 0.018 | 0.001 | 18.13 | 24.08 | 0.44 | 0.009 | 0.81 |
| | 2 | 0.100 | 0.49 | 0.21 | 0.003 | 0.001 | 18.48 | 25.71 | 0.04 | 0.007 | 0.77 |
| | 3 | 0.065 | 0.22 | 1.75 | 0.009 | 0.002 | 21.35 | 23.01 | 0.06 | 0.003 | 0.55 |
| | 4 | 0.070 | 0.45 | 1.08 | 0.012 | 0.001 | 24.89 | 25.89 | 0.09 | 0.007 | 0.47 |
| | 5 | 0.068 | 0.55 | 0.89 | 0.015 | 0.001 | 22.42 | 25.65 | 0.11 | 0.005 | 0.45 |
| | 6 | 0.059 | 0.62 | 0.76 | 0.004 | 0.002 | 19.75 | 24.78 | 0.30 | 0.007 | 0.41 |
| | 7 | 0.061 | 0.39 | 1.32 | 0.007 | 0.001 | 19.35 | 22.16 | 0.33 | 0.006 | 0.51 |
| | 8 | 0.053 | 0.49 | 0.89 | 0.016 | 0.003 | 23.46 | 25.64 | 0.17 | 0.008 | 0.48 |
| | 9 | 0.070 | 0.42 | 1.46 | 0.011 | 0.001 | 21.00 | 25.32 | 0.26 | 0.005 | 0.40 |
| | 10 | 0.031 | 0.47 | 2.51 | 0.012 | 0.001 | 24.94 | 25.44 | 0.78 | 0.008 | 0.31 |
| | 11 | 0.051 | 0.36 | 0.98 | 0.009 | 0.003 | 22.42 | 24.29 | 0.45 | 0.008 | 0.38 |
| | 12 | 0.085 | 0.44 | 1.21 | 0.014 | 0.002 | 20.13 | 26.01 | 0.42 | 0.007 | 0.71 |
| | 13 | 0.070 | 0.51 | 2.89 | 0.015 | 0.001 | 23.75 | 24.02 | 0.18 | 0.006 | 0.60 |
| | 14 | 0.070 | 0.55 | 1.78 | 0.005 | 0.001 | 24.70 | 22.98 | 0.31 | 0.005 | 0.45 |
| | 15 | 0.100 | 0.34 | 0.81 | 0.009 | 0.002 | 22.45 | 23.06 | 0.40 | 0.006 | 0.58 |
| | 16 | 0.060 | 0.57 | 0.29 | 0.012 | 0.001 | 19.98 | 24.99 | 0.60 | 0.006 | 0.42 |
| | 17 | 0.111 | 0.48 | 1.55 | 0.006 | 0.004 | 24.09 | 24.00 | 0.16 | 0.005 | 0.88 |
| | 18 | 0.078 | 0.31 | 0.80 | 0.005 | 0.001 | 20.10 | 25.25 | 0.07 | 0.008 | 0.47 |
| | 19 | 0.062 | 0.67 | 0.51 | 0.009 | 0.001 | 19.63 | 25.11 | 0.45 | 0.006 | 0.50 |
| | 20 | 0.059 | 0.52 | 0.72 | 0.005 | 0.002 | 18.19 | 24.90 | 0.44 | 0.006 | 0.49 |
| | 21 | 0.068 | 0.41 | 1.01 | 0.012 | 0.001 | 20.08 | 25.01 | 0.15 | 0.007 | 0.45 |
| | 22 | 0.064 | 0.22 | 0.99 | 0.015 | 0.001 | 20.77 | 24.01 | 0.22 | 0.005 | 0.43 |
| | 23 | 0.062 | 0.35 | 1.07 | 0.011 | 0.002 | 21.37 | 25.68 | 0.63 | 0.003 | 0.45 |
| | 24 | 0.070 | 0.49 | 1.32 | 0.018 | 0.001 | 23.78 | 25.85 | 0.45 | 0.007 | 0.39 |
| | 25 | 0.058 | 0.43 | 1.19 | 0.011 | 0.004 | 20.53 | 24.89 | 0.38 | 0.006 | 0.45 |
| | 26 | 0.062 | 0.38 | 1.25 | 0.010 | 0.002 | 20.01 | 25.04 | 0.40 | 0.007 | 0.44 |
| | 27 | 0.065 | 0.40 | 1.21 | 0.004 | 0.003 | 21.03 | 25.11 | 0.32 | 0.006 | 0.46 |
| Comparative | 28 | 0.086 | 0.26 | 1.21 | 0.023 | 0.003 | 20.45 | 24.78 | —* | —* | —* |
| | 29 | 0.115 | 0.52 | 1.11 | 0.018 | 0.001 | 18.89 | 25.02 | 0.07 | 0.008 | 0.92 |
| | 30 | 0.075 | 0.41 | 1.22 | 0.010 | 0.002 | 20.10 | 26.16 | 0.06 | 0.003 | 0.72 |
| | 31 | 0.064 | 0.67 | 1.06 | 0.017 | 0.002 | 22.31 | 27.89 | 0.42 | 0.011* | 0.55 |
| | 32 | 0.077 | 0.12 | 0.89 | 0.011 | 0.002 | 18.98 | 23.75 | 0.06 | 0.001* | 0.23 |
| | 33 | 0.081 | 0.89 | 0.94 | 0.025 | 0.003 | 19.06 | 28.98 | 0.08 | 0.006 | 0.38 |
| | 34 | 0.064 | 0.42 | 0.75 | 0.022 | 0.001 | 21.03 | 22.01 | 0.67 | 0.008 | 0.21 |
| | 35 | 0.055 | 0.25 | 1.06 | 0.019 | 0.002 | 22.70 | 28.16 | 0.08 | 0.102* | 0.76 |
| | 36 | 0.061 | 0.33 | 1.21 | 0.015 | 0.001 | 19.75 | 24.73 | 0.09 | 0.003 | 0.45 |

Note:
a mark * shows out of range defined in the present invention.

TABLE 2

(continued from Table 1)

| Steel | No. | Chemical Composition (unit: mass %, balance: Fe and impurities) | | | | | |
|---|---|---|---|---|---|---|---|
| | | V | B | sol. Al | N | O | Others |
| Present Invention | 1 | 0.03 | 0.0021 | 0.009 | 0.165 | 0.0051 | — |
| | 2 | 0.06 | 0.0032 | 0.014 | 0.111 | 0.0042 | W: 1.36 |
| | 3 | 0.07 | 0.0015 | 0.027 | 0.210 | 0.0032 | — |
| | 4 | 0.10 | 0.0035 | 0.007 | 0.191 | 0.0051 | Ca: 0.008 |
| | 5 | 0.11 | 0.0010 | 0.010 | 0.206 | 0.0066 | Mo: 0.32, W: 0.53 |
| | 6 | 0.36 | 0.0015 | 0.015 | 0.253 | 0.0079 | — |
| | 7 | 0.42 | 0.0021 | 0.008 | 0.215 | 0.0065 | — |
| | 8 | 0.06 | 0.0017 | 0.013 | 0.289 | 0.0050 | Mg: 0.006 |
| | 9 | 0.07 | 0.0031 | 0.012 | 0.176 | 0.0065 | Pd: 0.02, Hf: 0.01 |
| | 10 | 0.88 | 0.0058 | 0.015 | 0.294 | 0.0019 | — |
| | 11 | 0.08 | 0.0048 | 0.022 | 0.280 | 0.0050 | W: 0.23, Ca: 0.003 |
| | 12 | 0.03 | 0.0025 | 0.026 | 0.234 | 0.0050 | — |
| | 13 | 0.07 | 0.0028 | 0.006 | 0.216 | 0.0052 | La: 0.03, Ce: 0.10 |
| | 14 | 0.02 | 0.0017 | 0.007 | 0.341 | 0.0020 | — |
| | 15 | 0.15 | 0.0021 | 0.016 | 0.310 | 0.0007 | — |
| | 16 | 0.04 | 0.0019 | 0.009 | 0.201 | 0.0055 | — |
| | 17 | 0.45 | 0.0020 | 0.021 | 0.148 | 0.0051 | Mo: 0.98, W: 1.73, Mg: 0.004 |
| | 18 | 0.72 | 0.0013 | 0.019 | 0.189 | 0.0055 | — |
| | 19 | 0.61 | 0.0018 | 0.020 | 0.207 | 0.0040 | Y: 0.02 |
| | 20 | 0.80 | 0.0025 | 0.011 | 0.261 | 0.0061 | Zr: 0.06 |
| | 21 | 0.09 | 0.0011 | 0.007 | 0.245 | 0.0043 | — |
| | 22 | 0.10 | 0.0018 | 0.009 | 0.238 | 0.0050 | Nd: 0.01 |
| | 23 | 0.05 | 0.0006 | 0.003 | 0.220 | 0.0048 | — |
| | 24 | 0.12 | 0.0009 | 0.008 | 0.240 | 0.0052 | Mo: 1.31 |
| | 25 | 0.11 | 0.0021 | 0.008 | 0.250 | 0.0061 | W: 1.40 |
| | 26 | 0.11 | 0.0029 | 0.010 | 0.222 | 0.0059 | Hf: 0.05 |
| | 27 | 0.09 | 0.0025 | 0.007 | 0.262 | 0.0058 | Pd: 0.03 |
| Comparative | 28 | —* | —* | 0.021 | 0.077* | 0.0044 | — |
| | 29 | 0.02 | 0.0042 | 0.004 | 0.031* | 0.0102* | — |
| | 30 | 0.03 | 0.0017 | 0.006 | 0.089* | 0.0079 | — |
| | 31 | 0.04 | 0.0023 | 0.017 | 0.219 | 0.0032 | — |
| | 32 | 0.03 | 0.0025 | 0.025 | 0.273 | 0.0029 | — |
| | 33 | 0.03 | 0.0031 | 0.011 | 0.285 | 0.0121* | — |
| | 34 | 0.05 | 0.0055 | 0.026 | 0.198 | 0.0005* | — |
| | 35 | 0.06 | 0.0019 | 0.035* | 0.240 | 0.0077 | — |
| | 36 | 0.08 | 0.0004* | 0.015 | 0.148 | 0.0039 | — |

Note:
a mark * shows out of range defined in the present invention.

The steels of Nos. 1 to 15 and Nos. 29 to 36 were melted by use of a vacuum melting furnace of a volume of 50 kg, and the obtained steel ingots were finished to steel plates by the following Manufacturing Method A. And the steels of Nos. 16 to 28 were melted by use of a vacuum melting furnace of a volume of 150 kg, and the obtained steel ingots were made to cold-finished seamless tubes, each having an outer diameter of 50.8 mm, and a wall thickness of 8.0 mm, by the following Manufacturing Method B.

(1) Manufacturing Method A (Example in a case where the final working is hot working and final products are steel plates)

First Step: Heating to 1250° C.;

Second Step: Forming a steel plate, having a thickness of 15 mm, by hot forging of a forging ratio of 3 (cross-sectional reduction ratio of 300%) or more and at a working end temperature of 1200° C.;

Third Step: Cooling (air cooling) at a rate of 0.55° C./sec from 800° C. to 500° C. or less; and Fourth Step: Water cooling after holding the plate at 1220° C. for 15 minutes.

(2) Manufacturing Method B (Example in a case where the final working is cold working and the final products are steel tubes)

First Step: Forming a round bar from an ingot having an outer diameter of 175 mm by hot forging and machining the outside;

Second Step: Heating the round bar at 1250° C.;

Third Step: Hot-extruding the heated round bar at a working end temperature of 1200° C. and forming it into a crude tube having an outer diameter of 64 mm and a wall thickness of 10 mm;

Fourth Step: Drawing the crude tube at a cross-sectional reduction ratio of 30% at room temperature to form a cold-finished seamless tube having a product size; and Fifth Step: Holding the tube at 1220° C. for ten minutes and water cooling it.

The ASTM austenitic grain size numbers and the mixed grain ratios of the finished steel plates and tubes were examined respectively, in accordance with a method defined in ASTM, and the method described above. Then, from the steel plates and tubes, round bar creep test pieces, each having an outer diameter of 6 mm and a gauge length of 30 mm, were sampled, and the test pieces were subjected to a creep rupture test on the conditions of a temperature of 700° C. and a load stress of 100 MPa to check creep rupture time (h) and creep rupture reduction of area (%). It is noted that the ASTM austenitic grain size number and the mixed grain ratio were obtained by observing twenty views of the respective test pieces.

Table 3 shows the above-mentioned results of examinations.

TABLE 3

| Steel | No. | Method | ASTM grain size number (average value) | Mixed grain ratio (%) | Creep rupture time (h) | Creep rupture reduction of area (%) |
|---|---|---|---|---|---|---|
| Present Invention | 1 | A | 6.3 | 5 | 14,765.7 | 23 |
| | 2 | | 5.8 | 5 | 13,289.2 | 26 |
| | 3 | | 4.8 | 0 | 21,366.0 | 22 |
| | 4 | | 5.1 | 10 | 19,076.5 | 25 |
| | 5 | | 6.0 | 0 | 28,976.1 | 28 |
| | 6 | | 4.9 | 0 | 19,737.2 | 32 |
| | 7 | | 5.3 | 0 | 17,865.3 | 24 |
| | 8 | | 4.1 | 0 | 22,938.9 | 37 |
| | 9 | | 5.7 | 5 | 24,689.1 | 35 |
| | 10 | | 3.1 | 5 | 16,540.4 | 20 |
| | 11 | | 3.5 | 0 | 20,190.6 | 41 |
| | 12 | | 4.8 | 5 | 21,311.7 | 22 |
| | 13 | | 5.0 | 0 | 19,187.0 | 39 |
| | 14 | B | 4.8 | 5 | 23,701.8 | 25 |
| | 15 | | 5.4 | 5 | 18,794.1 | 31 |
| | 16 | | 5.8 | 0 | 16,589.9 | 26 |
| | 17 | | 6.1 | 5 | 35,410.2 | 21 |
| | 18 | | 5.7 | 0 | 17,731.1 | 28 |
| | 19 | | 5.3 | 10 | 20,464.3 | 27 |
| | 20 | | 4.8 | 0 | 19,882.0 | 40 |
| | 21 | | 4.2 | 0 | 16,564.2 | 21 |
| | 22 | | 5.2 | 5 | 24,198.8 | 41 |
| | 23 | | 6.4 | 10 | 18,672.0 | 44 |
| | 24 | | 3.8 | 5 | 21,162.3 | 36 |
| | 25 | | 5.4 | 5 | 31,450.7 | 27 |
| | 26 | | 4.6 | 5 | 29,629.0 | 43 |
| | 27 | | 5.8 | 0 | 32,407.6 | 37 |
| Comparative | 28 | | 4.4 | 10 | 1,231.8** | 66 |
| | 29 | A | 7.8* | 30* | 8,045.1** | 7** |
| | 30 | | 6.6 | 10 | 7,642.0** | 17 |
| | 31 | | 4.5 | 20* | 21,431.5 | 8** |
| | 32 | | 3.8 | 35* | 10,832.1 | 12** |
| | 33 | | 4.7 | 25* | 19,821.6 | 5** |
| | 34 | | 3.5 | 20* | 11,457.0 | 14** |
| | 35 | | 6.1 | 25* | 23,410.7 | 4** |
| | 36 | | 5.7 | 25* | 9,721.5** | 10** |

Note 1:
ASTM grain size number is an average value of 20 fields.
Note 2:
a mark * and a mark ** show out of range and target value defined in the present invention.

As can be seen from Table 3, in the steels of Nos. 1 to 27 obtained by treating steels having chemical compositions defined in the present invention with a method according to the present invention, the ASTM austenitic grain size numbers and the mixed grain ratios are all in a range defined in the present invention, and both the creep rupture time and the creep rupture reduction of area satisfy the target values of the present invention.

On the other hand, in the steels of No. 29 and Nos. 31 to 36 in the steels obtained by treating the steels whose chemical compositions are out of range defined in the present invention with a method according to the present invention, any one or both of the ASTM austenitic grain size numbers and the mixed grain ratios are out of range defined in the present invention, and any one or both of the creep rupture time and the creep rupture reduction of area does not satisfy the target values of the present invention.

Further, the steel of No. 28 is an existing steel of SUS 310, which does not contain Ti and Nb as well as Co, V and B. Although the microstructure of the steel is a uniform grain structure defined in the present invention and the creep rupture reduction of area is extremely good, the creep rupture time is 1231.8 hours, which is 1/10 or less of the case of the steel according to the present invention, which is extremely short. The steel of No. 30 is a steel having chemical composition in a range defined in the present invention except for N (Nitrogen). Accordingly, although the microstructure of the steel is a structure defined in the present invention and its creep rupture reduction of area satisfied the target value of the present invention, the N content is so small that the creep rupture time does not reach the target value of the present invention. It is noted that in said steels of No. 29 and Nos. 31 to 36, any one or both of the ASTM austenitic grain size numbers and the mixed grain ratios are out of range defined in the present invention, and any one or both of the creep rupture time and the creep rupture reduction of area does not satisfy the target values of the present invention. This is because the chemical composition of any one of the steels is out of range defined in the present invention, and particularly any one of the Ti and O (Oxygen) is out of range defined in the present invention including the steels No. 29 and Nos. 31 to 35.

INDUSTRIAL APPLICABILITY

According to the present invention, an austenitic stainless steel further excellent in creep rupture time and creep rupture reduction of area at 700° C. or more as compared with conventional 18-8 type or 25 Cr type steels can definitely be provided. Therefore, an extremely large effect on the recent year's promotion of high temperature and high-pressure steam in an electric power-generation boiler can be obtained.

What is claimed is:

1. An austenitic stainless steel which comprises, on the percent by mass basis, C: 0.03–0.12%, Si: 0.2–2%, Mn:

0.1–3%, P: 0.03% or less, S: 0.01% or less, Ni: more than 18% and less than 25%, Cr: more than 22% and less than 30%, Co: 0.04–0.8%, Ti: 0.002% or more and less than 0.01%, Nb: 0.1–1%, V: 0.01–1%, B: more than 0.0005% and 0.2% or less, sol. Al: 0.0005% or more and less than 0.03%, N: 0.1–0.35% and O (Oxygen): 0.001–0.008%, with the balance being Fe and impurities.

2. The austenitic stainless steel excellent in high temperature strength and creep rupture ductility according to claim 1, wherein the microstructure of the said steel is a uniform grain structure having the ASTM austenitic grain size number of 0 or more and less than 7 and the mixed grain ratio of 10% or less.

3. The austenitic stainless steel excellent in high temperature strength and creep rupture ductility according to claim 1, wherein, for said steel, a creep rupture time exceeds 10,000 hours under the conditions of 700° C. and a load stress of 100 MPa, the steel having a creep rupture reduction in area of 15% or more.

4. An austenitic stainless steel which comprises, on the percent by mass basis, C: 0.03–0.12%, Si: 0.2–2%, Mn: 0.1–3%, P: 0.03% or less, S: 0.01% or less, Ni: more than 18% and less than 25%, Cr: more than 22% and less than 30%, Co: 0.04–0.8%, Ti: 0.002% or more and less than 0.01%, Nb: 0.1–1%, V: 0.01–1%, B: more than 0.0005% and 0.2% or less, sol. Al: 0.0005% or more and less than 0.03%, N: 0.1–0.35%, O (Oxygen): 0.001–0.008% and one or more element(s) selected from a group of Mo and W of 0.1–5% in single or total content, with the balance being Fe and impurities.

5. The austenitic stainless steel excellent in high temperature strength and creep rupture ductility according to claim 4, wherein the microstructure of the said steel is a uniform grain structure having the ASTM austenitic grain size number of 0 or more and less than 7 and the mixed grain ratio of 10% or less.

6. The austenitic stainless steel excellent in high temperature strength and creep rupture ductility according to claim 4, wherein, for said steel, a creep rupture time exceeds 10,000 hours under the conditions of 700° C. and a load stress of 100 MPa, the steel having a creep rupture reduction in area of 15% or more.

7. An austenitic stainless steel which comprises, on the percent by mass basis, C: 0.03–0.12%, Si: 0.2–2%, Mn: 0.1–3%, P: 0.03% or less, S: 0.01% or less, Ni: more than 18% and less than 25%, Cr: more than 22% and less than 30%, Co: 0.04–0.8%, Ti: 0.002% or more and less than 0.01%, Nb: 0.1–1%, V: 0.01–1%, B: more than 0.0005% and 0.2% or less, sol. Al: 0.0005% or more and less than 0.03%, N: 0.1–0.35%, O (Oxygen): 0.001–0.008% and one or more element(s) selected from a group of Mg of 0.0005–0.01%, Zr of 0.0005–0.2%, Ca of 0.0005–0.05%, REM of 0.0005–0.2%, Pd of 0.0005–0.2%, and Hf of 0.0005–0.2%, with the balance being Fe and impurities.

8. The austenitic stainless steel excellent in high temperature strength and creep rupture ductility according to claim 7, wherein the microstructure of the said steel is a uniform grain structure having the ASTM austenitic grain size number of 0 or more and less than 7 and the mixed grain ratio of 10% or less.

9. The austenitic stainless steel excellent in high temperature strength and creep rupture ductility according to claim 7, wherein, for said steel, a creep rupture time exceeds 10,000 hours under the conditions of 700° C. and a load stress of 100 MPa, the steel having a creep rupture reduction in area of 15% or more.

10. An austenitic stainless steel which comprises, on the percent by mass basis, C: 0.03–0.12%, Si: 0.2–2%, Mn: 0.1–3%, P: 0.03% or less, S: 0.01% or less, Ni: more than 18% and less than 25%, Cr: more than 22% and less than 30%, Co: 0.04–0.8%, Ti: 0.002% or more and less than 0.01%, Nb: 0.1–1%, V: 0.01–1%, B: more than 0.0005% and 0.2% or less, sol. Al: 0.0005% or more and less than 0.03%, N: 0.1–0.35%, O (Oxygen): 0.001–0.008%, one or more element(s) selected from a group of Mo and W of 0.1–5% in single or total content and one or more element(s) selected from a group of Mg of 0.0005–0.01%, Zr of 0.0005–0.2%, Ca of 0.0005–0.05%, REM of 0.0005–0.2%, Pd of 0.0005–0.2%, and Hf of 0.0005–0.2%, with the balance being Fe and impurities.

11. The austenitic stainless steel excellent in high temperature strength and creep rupture ductility according to claim 10, wherein the microstructure of the said steel is a uniform grain structure having the ASTM austenitic grain size number of 0 or more and less than 7 and the mixed grain ratio of 10% or less.

12. The austenitic stainless steel excellent in high temperature strength and creep rupture ductility according to claim 10, wherein, for said steel, a creep rupture time exceeds 10,000 hours under the conditions of 700° C. and a load stress of 100 MPa, the steel having a creep rupture reduction in area of 15% or more.

* * * * *